US010408219B2

(12) United States Patent
Sakai et al.

(10) Patent No.: US 10,408,219 B2
(45) Date of Patent: Sep. 10, 2019

(54) FUEL PUMP

(71) Applicant: DENSO CORPORATION, Kariya, Aichi-pref. (JP)

(72) Inventors: Hiromi Sakai, Kariya (JP); Kiyoshi Nagata, Kariya (JP); Masaya Ootake, Kariya (JP)

(73) Assignee: DENSO CORPORATION, Kariya (JP)

( * ) Notice: Subject to any disclaimer, the term of this patent is extended or adjusted under 35 U.S.C. 154(b) by 134 days.

(21) Appl. No.: 15/022,336

(22) PCT Filed: Sep. 15, 2014

(86) PCT No.: PCT/JP2014/004741
§ 371 (c)(1),
(2) Date: Mar. 16, 2016

(87) PCT Pub. No.: WO2015/040849
PCT Pub. Date: Mar. 26, 2015

(65) Prior Publication Data

US 2016/0230772 A1 Aug. 11, 2016

(30) Foreign Application Priority Data

Sep. 17, 2013 (JP) ..... 2013-191595

(51) Int. Cl.
*F04D 13/00* (2006.01)
*F04D 29/046* (2006.01)
(Continued)

(52) U.S. Cl.
CPC ..... *F04D 29/046* (2013.01); *F02M 37/048* (2013.01); *F04D 3/005* (2013.01);
(Continued)

(58) Field of Classification Search
CPC ..... F04D 29/046; F04D 3/005; F04D 13/06; F04D 5/002; F02M 37/08; F02M 37/048
(Continued)

(56) References Cited

U.S. PATENT DOCUMENTS 2,965,038 A * 12/1960 Purden ..... F02M 37/08 174/152 R
4,449,891 A * 5/1984 Kemmner ..... F02M 37/048 415/170.1
(Continued)

FOREIGN PATENT DOCUMENTS

JP 2007-113708 5/2007
JP 2009-222055 10/2009
(Continued)

OTHER PUBLICATIONS

International Search Report and Written Opinion of the ISA for PCT/JP2014/004741, dated Dec. 2, 2014, 11 pages.

*Primary Examiner* — Christopher S Bobish
(74) *Attorney, Agent, or Firm* — Nixon & Vanderhye P.C.

(57) ABSTRACT

A fuel pump includes a pump cover at one end portion of the housing, a cover end at the other end portion of the housing, a bearing supported by the cover end and rotatably supporting an end portion of the shaft on the cover end-side. The cover end includes a base part that covers the other end portion, a discharge part that is connected to the base part, a bearing accommodating part which is formed such that a cross-section of the bearing accommodating part perpendicular to a rotation axis of the shaft has an annular shape and which includes an accommodating space accommodating the bearing, and a connection part that connects together the base part and the bearing accommodating part. A length of the connection part is shorter than a length of the base part and a length of the bearing accommodating part, in a direction of the rotation axis.

6 Claims, 3 Drawing Sheets

(51) Int. Cl.

| | |
|---|---|
| ***F04D 5/00*** | (2006.01) |
| ***F04D 29/66*** | (2006.01) |
| ***F02M 37/04*** | (2006.01) |
| ***F04D 3/00*** | (2006.01) |
| ***F04D 13/06*** | (2006.01) |
| ***F04D 29/52*** | (2006.01) |
| ***F04D 29/047*** | (2006.01) |
| *F02M 59/44* | (2006.01) |

(52) U.S. Cl.
CPC ..... *F04D 5/002* (2013.01); *F04D 13/06* (2013.01); *F04D 29/047* (2013.01); *F04D 29/528* (2013.01); *F04D 29/668* (2013.01); *F02M 59/44* (2013.01)

(58) Field of Classification Search
USPC ..... 417/423.1, 423.12, 423.14
See application file for complete search history.

(56) References Cited

U.S. PATENT DOCUMENTS 4,492,515 A * 1/1985 Watanabe ..... F04D 5/002 415/55.5
4,715,777 A * 12/1987 Tuckey ..... F02M 37/048 415/55.1
4,726,746 A * 2/1988 Takada ..... F02M 37/08 417/366
5,173,037 A * 12/1992 Martin ..... F02M 37/08 417/423.14
5,413,468 A * 5/1995 Tuckey ..... F02M 37/0041 417/366
8,288,903 B2 * 10/2012 Matsuda ..... H02K 1/148 310/43
8,734,133 B2 * 5/2014 Tanahashi ..... F04D 5/002 310/71
2002/0085930 A1 * 7/2002 Hiraiwa ..... F04D 5/002 417/307
2004/0101427 A1 * 5/2004 Yu ..... F04C 2/102 418/15
2007/0025866 A1 * 2/2007 Douyama ..... F04B 17/03 417/423.3
2007/0052310 A1 * 3/2007 Sakai ..... F02M 37/048 310/87
2007/0210673 A1 9/2007 Kusagaya
2009/0191074 A1 * 7/2009 Suzuki ..... F04D 13/06 417/423.7
2010/0034674 A1 * 2/2010 Oota ..... F02M 37/08 417/410.1
2011/0110799 A1 * 5/2011 Kawai ..... F04D 5/002 417/321

FOREIGN PATENT DOCUMENTS

JP 2012-31807 2/2012
JP 2013-150536 8/2013

* cited by examiner

FUEL PUMP

CROSS REFERENCE TO RELATED APPLICATION

This application is the U.S. National Phase of International Application No. PCT/JP2014/004741 filed on Sep. 15, 2014, which designated the U.S. and claims priority to Japanese Patent Application No. 2013-191595 filed on Sep. 17, 2013, the entire contents of each of which are incorporated herein by reference.

TECHNICAL FIELD

The present disclosure relates to a fuel pump.

BACKGROUND ART

There is known a fuel pump which includes an impeller that is rotatable in a pump chamber and a motor that can rotate the impeller and which pressure-feeds fuel in a fuel tank to an internal-combustion engine by the rotation of the impeller. In Patent Document 1, there is described a fuel pump that includes a motor having a stator and a rotor supported rotatably radially inward of the stator to rotate an impeller using rotational movement of the rotor.

PRIOR ART DOCUMENT

Patent Document

Patent Document 1: JP2012-31807A

In the fuel pump described in Patent Document 1, a shaft that rotates integrally with the rotor is supported rotatably by two bearings provided at two end portions of the fuel pump. One bearing is provided near the impeller that is connected to one end portion of the shaft. The other bearing supporting the other end portion of the shaft is accommodated in a cover end that is provided at an end portion of a housing which accommodates the stator and the rotor. When the fuel pump is driven, wobbling movement of the shaft is caused due to rotation of the rotor. In this case, the other end portion of the shaft swings to draw a circle, and the cover end may thereby be damaged by radial force applied to the bearing if the other bearing is fixed to the cover end.

SUMMARY OF INVENTION

It is an objective of the present disclosure to provide a fuel pump that prevents damage to a cover end which accommodates a bearing of a shaft.

A fuel pump in an aspect of the present disclosure includes a cylindrical housing, a pump cover that is provided at one end portion of the housing and includes an inlet port which draws fuel into the housing, a cover end that is provided at the other end portion of the housing and includes a discharge port which discharges fuel to outside of the housing, a stator, a rotor, a shaft that is provided coaxially with the rotor and rotates integrally with the rotor, a bearing that is accommodated in the cover end and rotatably supports an end portion of the shaft on the cover end-side, and an impeller. The cover end includes a base part that covers the other end portion of the housing, a discharge part that is connected to the base part and includes the discharge port, a bearing accommodating part which is formed such that a cross-section of the bearing accommodating part perpendicular to a rotation axis of the shaft has an annular shape and which includes an accommodating space that accommodates the bearing, and a connection part that connects together the base part and the bearing accommodating part. A length of the connection part in a direction of the rotation axis of the shaft is shorter than a length of the base part in the direction of the rotation axis of the shaft, and a length of the bearing accommodating part in the direction of the rotation axis of the shaft.

The wobbling movement of the shaft produced when the fuel pump is driven applies the radial force to the bearing, and to the bearing accommodating part which accommodates the bearing. In the fuel pump of the present disclosure, the length of the connection part in the direction of the rotation axis of the shaft is shorter than the length of the base part in the direction of the rotation axis of the shaft, and the length of the bearing accommodating part in the direction of the rotation axis of the shaft. The rigidity of the connecting part is lower than the bearing accommodating part and the base part. The cross-section of the bearing accommodating part perpendicular to the rotation axis of the shaft has an annular shape, and the endurance against the radially-applied force does not change according to the direction. Accordingly, the radial force applied due to the wobbling movement of the shaft is absorbed by the resilient deformation of the bearing accommodating part and the connecting part. Thus, damage to the cover end by the wobbling movement of the shaft can be prevented.

BRIEF DESCRIPTION OF DRAWINGS

The above and other objects, features and advantages of the present disclosure will become more apparent from the following detailed description made with reference to the accompanying drawings. In the drawings.

EMBODIMENT FOR CARRYING OUT INVENTION

An embodiment will be described below with reference to the accompanying drawings.

Figure 1:
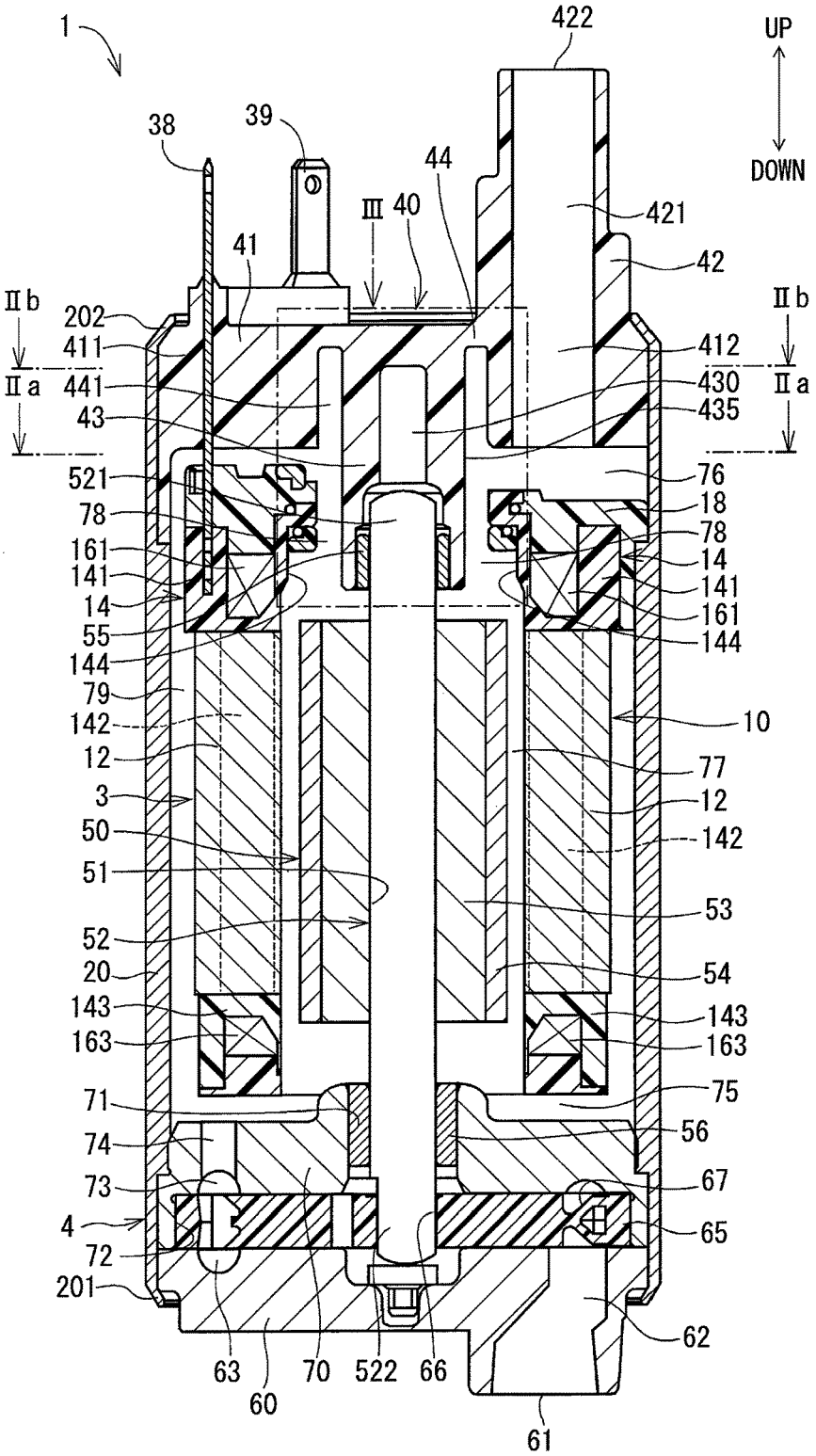
FIG. 1 is a sectional view illustrating a fuel pump in accordance with an embodiment.
Figure 2A:
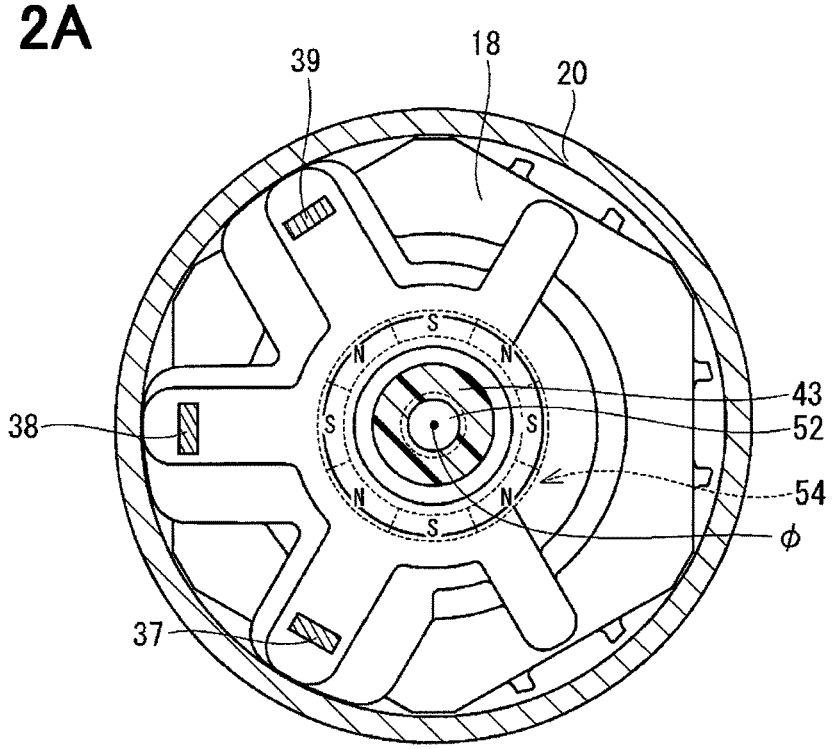
FIG. 2A is a diagram viewed from arrows IIa in FIG. 1.
Figure 2B:
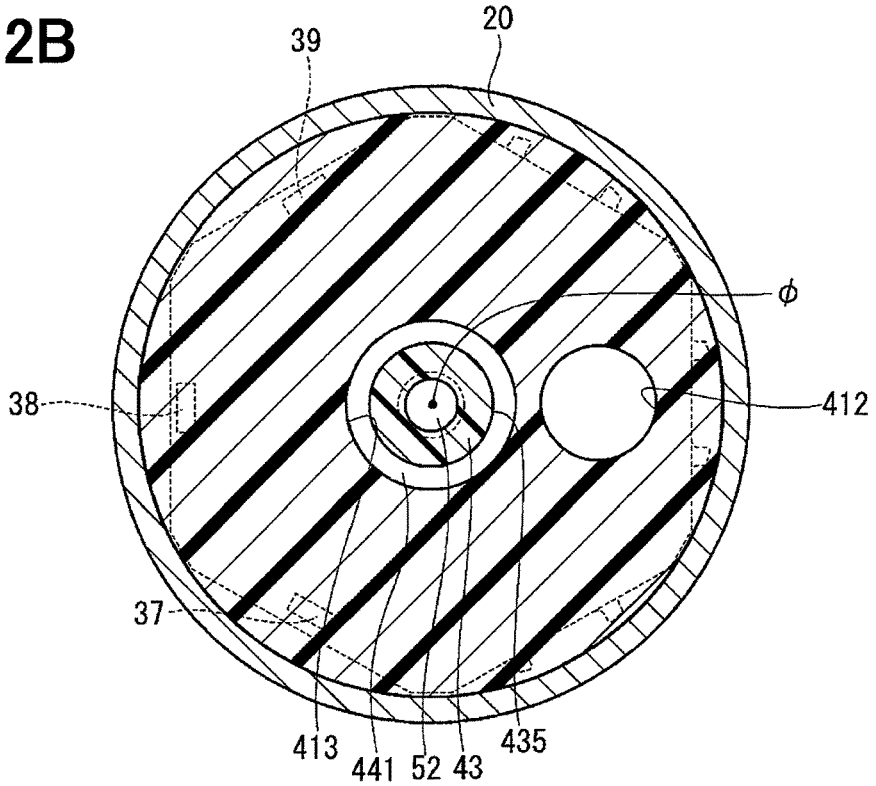
FIG. 2B is a diagram viewed from arrows IIb in FIG. 1.
Figure 3:
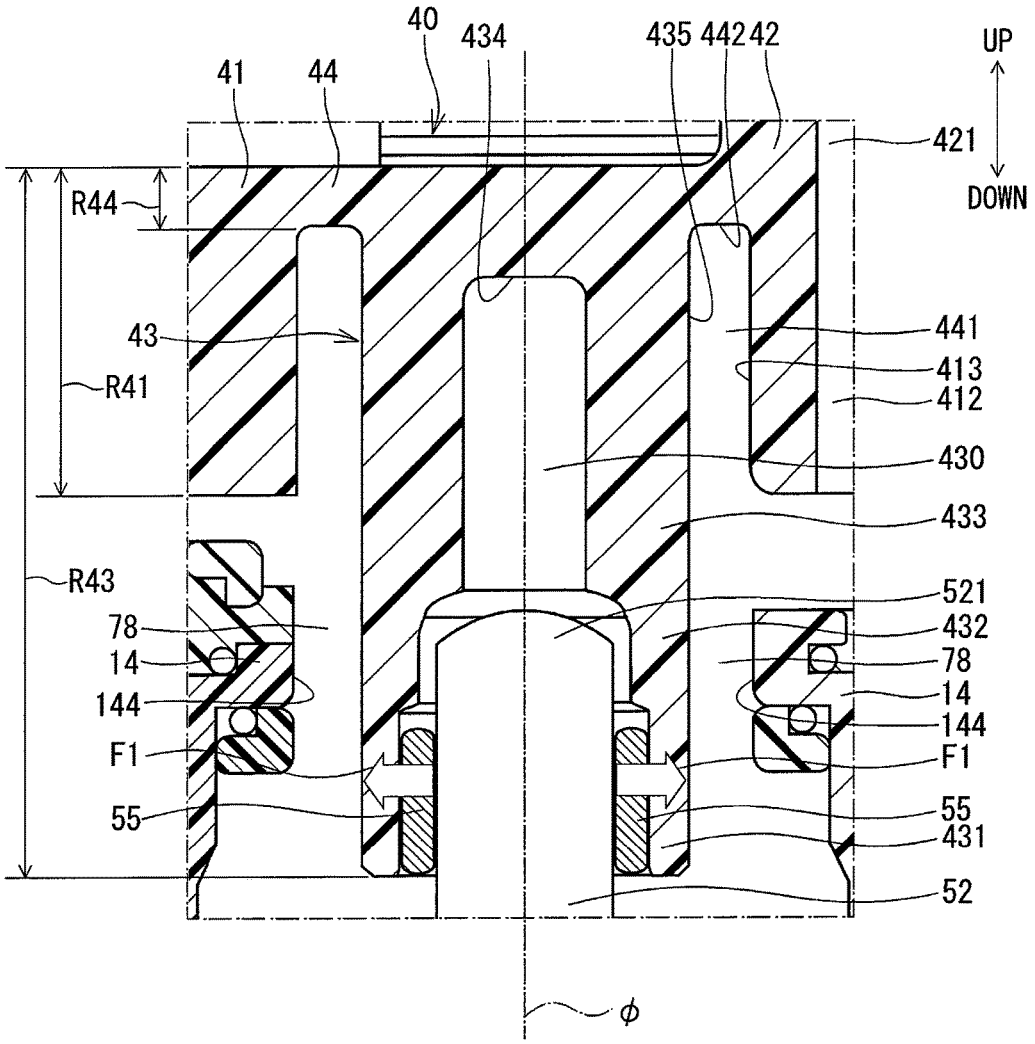
FIG. 3 is an enlarged view of a part III in FIG. 1.

A fuel pump of the embodiment will be explained based on FIGS. 1 to 3.

A fuel pump 1 includes a motor part 3, a pump part 4, a housing 20, a pump cover 60, and a cover end 40. In the fuel pump 1, the motor part 3 and the pump part 4 are accommodated in a space defined by the housing 20, the pump cover 60, and the cover end 40. The fuel pump 1 draws in fuel in a fuel tank (not shown) from an inlet port 61 illustrated on a lower side in FIG. 1, and discharges fuel into an internal-combustion engine through a discharge port 422 illustrated on an upper side of FIG. 1. In FIG. 1, the upper side is indicated as "UP side" and the lower side is indicated as "DOWN side".

The housing 20 is formed in a cylindrical shape from metal such as iron. The pump cover 60 covers an end portion 201 of the housing 20 on the inlet port 61-side. The pump cover 60 is fixed inside the housing 20 by the edge of the end portion 201 being crimped inward, thereby restricting separation of the pump cover 60 in the axial direction.

The cover end 40 is formed from resin, and covers an end portion 202 of the housing 20 on the discharge port 422-side.

The cover end 40 includes a base part 41, a discharge part 42, a bearing accommodating part 43, and a connection part 44.

The base part 41 is formed generally annularly, and is provided to cover the end portion 202 of the housing 20. An edge portion 411 of the base part 41 radially outward of the base part 41 is crimped by the edge of the end portion 202 of the housing 20. Accordingly, the base part 41 is fixed inside the housing 20, thereby restricting separation of the base part 41 in the axial direction. The base part 41 includes a fuel passage 412 communicating with a fuel passage 421 of the discharge part 42 at a position shifted from the center of the fuel pump 1. The discharge part 42 is connected to the portion of the base part 41 outside the housing 20.

The discharge part 42 is formed in a generally cylindrical shape, and is provided at a position shifted from the center of the base part 41 to extend outward of the housing 20. The discharge part 42 includes the fuel passage 421 and the discharge port 422, through which fuel inside the housing 20 flows.

The bearing accommodating part 43 is formed in a generally cylindrical shape with a bottom, and is provided to extend in a direction inward of the housing 20 from the generally central portion of the base part 41. The bearing accommodating part 43 includes therein an accommodating space 430 in which an end portion 521 of a shaft 52, and a bearing 55 that rotatably supports the end portion 521 are accommodated. The bearing accommodating part 43 includes a large inner diameter portion 431, an intermediate inner diameter portion 432, and a small inner diameter portion 433. The bearing accommodating part 43 is formed such that its cross-section perpendicular to the rotation axis ϕ of the shaft 52 has an annular shape having a constant curvature, i.e., a shape obtained by overlapping the centers of two true circles having different radii with each other, as illustrated in FIGS. 2A and 2B.

The large inner diameter portion 431 is located on the motor part 3-side of the bearing accommodating part 43. The bearing 55 is press-fitted and fixed in the large inner diameter portion 431.

The intermediate inner diameter portion 432 includes therein a columnar space having a smaller inner diameter than an inner diameter of the accommodating space 430 in the large inner diameter portion 431. The intermediate inner diameter portion 432 connects together the large inner diameter portion 431 and the small inner diameter portion 433. The end portion 521 of the shaft 52 is located in the intermediate inner diameter portion 432.

The small inner diameter portion 433 includes therein a columnar space having a smaller inner diameter than the inner diameter of the accommodating space 430 in the intermediate inner diameter portion 432. The small inner diameter portion 433 is connected to an end portion of the intermediate inner diameter portion 432 on the opposite side from its end portion connected to the large inner diameter portion 431. The small inner diameter portion 433 includes a bottom wall 434 that defines the accommodating space 430 and that is provided generally perpendicular to the rotation axis ϕ of the shaft 52. The connection part 44 is a part connecting together the base part 41 and the bearing accommodating part 43 radially outward of the small inner diameter portion 433 of the bearing accommodating part 43. As illustrated in FIG. 3, the connection part 44 is formed such that a thickness R44 that is a length of the connection part 44 in the direction of the rotation axis ϕ of the shaft 52 is smaller than a thickness R41 that is a length of the base part 41 in the direction of the rotation axis ϕ and a thickness R43 that is a length of the bearing accommodating part 43 in the direction of the rotation axis ϕ. Accordingly, an annular groove 441 is defined between an inner wall 413 of the base part 41 radially inward thereof and an outer wall 435 of the bearing accommodating part 43. A bottom wall 442 as an "inner wall" defining the groove 441 is located further on UP side than the bottom wall 434 defining the accommodating space 430. The thickness R44 of the connection part 44 has such a thickness as to resist the pressure of fuel in the housing 20.

The motor part 3 includes a stator 10, a rotor 50, and the shaft 52. The motor part 3 is a brush-less motor, in which a rotating magnetic field is generated when electric power is supplied to the stator 10 and the rotor 50 rotates together with the shaft 52.

The stator 10 has a cylindrical shape, and is accommodated radially outward in the housing 20. The stator 10 includes six cores 12, six bobbins, six winding wires, and three energization terminals. The stator 10 is formed integrally by molding these members in a resin 18.

Each of the cores 12 is formed by stacking more than one sheet of magnetic materials such as plate-shaped irons. The cores 12 are arranged in the circumferential direction, and are provided at positions opposed to a magnet 54 of the rotor 50.

The bobbin 14 is formed from a resin material. At the time of formation of the bobbin 14, the cores 12 are inserted respectively in the bobbin 14 and the bobbin 14 is provided integrally with the cores 12. The bobbin 14 includes an upper end portion 141 that is formed on the discharge port 422-side, an insertion portion 142 in which the cores 12 are inserted, and a lower end portion 143 that is formed on the inlet port 61-side.

The winding wire is, for example, a copper wire whose surface is coated with an insulating film. The winding wire is wound on the bobbin 14 in which the cores 12 are inserted. The winding wire includes an upper end winding portion 161 that is wound on the upper end portion 141 of the bobbin 14, an insertion winding portion that is wound on the insertion portion 142 of the bobbin 14, and a lower end winding portion 163 that is wound on the lower end portion 143 of the bobbin 14. The winding wire is electrically connected to any one of a W-phase terminal 37, a V-phase terminal 38, and a U-phase terminal 39 which are provided on UP side of the fuel pump 1.

The W-phase terminal 37, the V-phase terminal 38, and the U-phase terminal 39 are fixed to the upper end portions 141 of the different bobbins 14 by press-fitting, and project in the axial direction. Three-phase electric power from a power supply device (not shown) is supplied to the W-phase terminal 37, the V-phase terminal 38, and the U-phase terminal 39.

The rotor 50 is accommodated rotatably inward of the stator 10. The rotor 50 includes the magnet 54 around an iron core 53. As illustrated in FIG. 2A, the magnet 54 serving as a "magnetic pole" includes N-poles and S-poles which are arranged alternately in the circumferential direction. In the embodiment, four pairs of N-poles and S-poles, i.e., eight poles of N-poles and S-poles in total are provided.

The shaft 52 is press-fitted and fixed in a shaft hole 51 that is formed along the rotation axis of the rotor 50 to rotate together with the rotor 50.

The configuration of the pump part 4 will be described. As illustrated in FIG. 1, the pump cover 60 includes the cylindrical inlet port 61 which opens toward DOWN side. An inlet passage 62 that passes through the pump cover 60 in the direction of the rotation axis ϕ of the shaft 52 is formed inside the inlet port 61. A pump casing 70 is formed in a generally disk-shape between the pump cover 60 and the stator 10. A hole 71 passing through the pump casing 70 in its thickness direction is formed at a central part of the pump casing 70. A bearing 56 is fitted in the hole 71. The bearing 56 rotatably supports an end portion 522 of the shaft 52 on a pump chamber 72-side together with the bearing 55 of the cover end 40. Accordingly, the rotor 50 and the shaft 52 are made rotatable relative to the cover end 40 and the pump casing 70.

An impeller 65 is formed from resin in a generally disk-shape. The impeller 65 is accommodated in the pump chamber 72 between the pump cover 60 and the pump casing 70. The end portion of the shaft 52 on the pump chamber 72-side has a D-shape whose outer wall is partly cut. The end portion 522 of the shaft 52 is fitted in its corresponding D-shaped hole 66 that is formed at a central part of the impeller 65. Accordingly, the impeller 65 rotates in the pump chamber 72 by the rotation of the shaft 52.

A groove 63 which is connected to the inlet passage 62 is formed on a surface of the pump cover 60 on the impeller 65-side. A groove 73 is formed on a surface of the pump casing 70 on the impeller 65-side. A fuel passage 74 passing through the pump casing 70 in the direction of the rotation axis $\phi$ of the shaft 52 communicates with the groove 73. The impeller 65 includes a vane part 67 at positions corresponding to the groove 63 and the groove 73.

In the fuel pump 1, when electric power is supplied to the winding wire of the motor part 3, the impeller 65 rotates together with the rotor 50 and the shaft 52. When the impeller 65 rotates, fuel in the fuel tank accommodating the fuel pump 1 is guided into the groove 63 through the inlet port 61. The fuel guided into the groove 63 has its pressure increased by the rotation of the impeller 65, and is guided into the groove 73. The fuel whose pressure has been increased flows through the fuel passage 74, and is guided into an intermediate chamber 75 that is formed between the pump casing 70 and the motor part 3. The fuel guided into the intermediate chamber 75 flows through a fuel passage running longitudinally through the motor part 3.

In the fuel pump 1 of the present embodiment, more than one fuel passage are formed as the fuel passage running longitudinally through the motor part 3. A part of the fuel guided into the intermediate chamber 75 flows through a fuel passage 77 between an outer wall of the rotor 50 and an inner wall of the stator 10, and through a fuel passage 78 between the outer wall 435 of the bearing accommodating part 43 of the cover end 40 and an inner wall 144 of the bobbin 14. Another part of the fuel guided into the intermediate chamber 75 flows through a fuel passage 79 between an outer wall of the stator 10 and an inner wall of the housing 20. The fuel flowing through the fuel passages 77, 78, 79 is guided into an intermediate chamber 76 that is formed between the motor part 3 and the cover end 40.

The intermediate chamber 76 communicates with the groove 441 which is formed radially outward of the bearing accommodating part 43. Accordingly, a part of the fuel flowing through the fuel passages 77, 78, 79 is retained in the groove 441. The fuel flowing through the intermediate chamber 76 is discharged to the outside through the fuel passage 421 and the discharge port 422.

In the fuel pump 1, when the rotor 50 rotates in the motor part 3, wobbling movement of the shaft 52 is caused. Due to this wobbling movement, the end portion of the shaft 52 that is not connected to the impeller 65 swings to draw a circle. In the fuel pump 1 of the embodiment, the end portion 521 of the shaft 52 sways to draw a circle with a point on the rotation axis $\phi$ generally as the center. Accordingly, the radially outward force F1 is applied to the end portion 521 and to the large inner diameter portion 431 of the bearing accommodating part 43 as illustrated in FIG. 3. The cross-sectional shape of the bearing accommodating part 43 of the fuel pump 1 is a shape obtained by overlapping the centers of two true circles having different radii with each other. Moreover, the bearing accommodating part 43 is connected to the base part 41 through the connection part 44 having a relatively small thickness. As a result, the bearing accommodating part 43 is provided such that the endurance against the force F1 does not change according to the direction, and the application of the force F1 is alleviated by a moderate fluctuation of the bearing accommodating part 43 due to a resilient deformation of the connection part 44 having a relatively small rigidity. Thus, damage to the cover end 40 by the wobbling movement of the shaft 52 can be prevented.

In the fuel pump 1 of the embodiment, the fuel passage 78 and the groove 441, through which fuel passes, are formed radially outward of the bearing accommodating part 43. Accordingly, when the end portion 521 of the shaft 52 swings due to the wobbling movement, the fuel in the fuel passage 78 and the groove 441 function as a damper to attenuate the vibration of the bearing accommodating part 43. Thus, the damage to the cover end 40 by the wobbling movement of the shaft 52 can be further prevented.

The bottom wall 434 of the accommodating space 430, in which the end portion 521 of the shaft 52 and the bearing 55 are accommodated, is formed further on DOWN side than the bottom wall 442 of the groove 441. Accordingly, the space radially outward of the end portion 521 of the shaft 52 and the bearing 55 is filled with fuel.

Heat is generated between the end portion 521 of the shaft 52 and the bearing 55 due to the wobbling movement of the shaft 52. This heat generated by the wobbling movement is transmitted to the bearing accommodating part 43 via the bearing 55. In the fuel pump 1, the bearing accommodating part 43 to which the heat is transmitted is cooled by the fuel passing through the fuel passage 78 and the groove 441. Accordingly, the bearing 55 and the bearing accommodating part 43 can be prevented from being heated. As a result, for example, heat deformation of the cover end 40 can be prevented.

The fuel passing through the fuel passage 78 and the groove 441 damps the vibration of the pump part 4 that is transmitted to the housing 20 and so forth via the bearing accommodating part 43. Accordingly, the transmission of the vibration produced in the pump part 4 can be restrained to make small a noise generated by the fuel pump 1.

Modifications to the above embodiment will be described. In the above-described embodiment, the cross-section of the bearing accommodating part perpendicular to the rotation axis of the shaft has an annular shape having a constant curvature, i.e., a shape obtained by overlapping the centers of two true circles having different radii with each other. However, the cross-sectional shape of the bearing accommodating part is not limited to this shape. Even without a constant curvature, any shape may be employed as long as it is annularly formed and has isotropic endurance against the radial force applied to the bearing accommodating part.

In the above-described embodiment, the bottom wall of the bearing accommodating part that defines the accommodating space is formed further on DOWN side than the bottom wall defining the groove. However, the positional relationship between the bottom wall of the accommodating space and the bottom wall of the groove is not limited to this example.

The present disclosure is not limited to this embodiment, and can be worked in various modes without departing from the scope of the disclosure.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A fuel pump comprising:

a cylindrical housing;

a pump cover that is provided at one end portion of the housing and includes an inlet port through which fuel is drawn into the housing;

a cover end that is provided at the other end portion of the housing and includes a discharge port through which fuel is discharged to outside of the housing;

a cylindrical stator on which a plurality of winding wires are wound and which is accommodated inside the housing;

a rotor that is rotatably provided radially inward of the stator;

a shaft that is provided coaxially with the rotor and rotates integrally with the rotor;

a bearing that is supported by the cover end and rotatably supports an end portion of the shaft on the cover end-side; and an impeller that is provided at an end portion of the shaft on the pump cover-side and rotates together with the shaft to pressurize fuel flowing in through the inlet port and to discharge the pressurized fuel through the discharge port, wherein:

the cover end includes:

a base part that covers the other end portion of the housing;

a discharge part that is connected to the base part and includes the discharge port;

a bearing accommodating part which includes an accommodating space that accommodates the bearing and which is formed such that a cross-section of the bearing accommodating part perpendicular to a rotation axis of the shaft has an annular shape point-symmetric with respect to a central axis of the accommodating space; and a connection part that connects together the base part and the bearing accommodating part;

the bearing accommodating part includes a large inner diameter portion that supports the bearing, an intermediate inner diameter portion that is located between the large inner diameter portion and the connection part, and that has a thickness greater than the thickness of the large inner diameter portion, and a small inner diameter portion that is located between the intermediate inner diameter portion and the connection part, that is located between the large inner diameter portion and the connection part, that has a thickness greater than a thickness of the large inner diameter portion and greater than the thickness of the intermediate inner diameter portion, and that has an inner diameter smaller than a diameter of the shaft;

a length of the connection part in a direction of the rotation axis of the shaft is shorter than a length of the base part in the direction of the rotation axis of the shaft, and is shorter than a length of the bearing accommodating part in the direction of the rotation axis of the shaft;

a first distance between an upper end of the shaft and a lower end of the small inner diameter portion in the direction of the rotation axis of the shaft is shorter than a second distance between an upper end of the rotor and a lower end of the large inner diameter portion in the direction of the rotation axis of the shaft; and a third distance between an upper end of the small inner diameter portion and the lower end of the small diameter portion is greater than a fourth distance between an upper end of the intermediate inner diameter portion and the lower end of the large inner diameter portion.

2. The fuel pump according to claim 1, wherein a bottom wall that defines the accommodating space is located further inward of the housing than an inner wall of the connection part.

3. The fuel pump according to claim 1, wherein the bearing is cylindrical.

4. The fuel pump according to claim 1, wherein the cover end comprises an annular groove between a radially inward facing inner wall of the base part and an outer wall of the bearing accommodating part.

5. A fuel pump comprising:

a cylindrical housing;

a pump cover that is provided at one end portion of the housing and includes an inlet port through which fuel is drawn into the housing;

a cover end that is provided at the other end portion of the housing and includes a discharge port through which fuel is discharged to outside of the housing;

a cylindrical stator on which a plurality of winding wires are wound and which is accommodated inside the housing;

a rotor that is rotatably provided radially inward of the stator;

a shaft that is provided coaxially with the rotor and rotates integrally with the rotor;

a bearing that is supported by the cover end and rotatably supports an end portion of the shaft on the cover end-side; and an impeller that is provided at an end portion of the shaft on the pump cover-side and rotates together with the shaft to pressurize fuel flowing in through the inlet port and to discharge the pressurized fuel through the discharge port, wherein:

the cover end includes:

a base part that covers the other end portion of the housing;

a discharge part that is connected to the base part and includes the discharge port;

a bearing accommodating part that includes an accommodating space that accommodates the bearing, that is formed such that a cross-section of the bearing accommodating part perpendicular to a rotation axis of the shaft has an annular shape point-symmetric with respect to a central axis of the accommodating space, and that has an axial length longer than an axial length of the base part; and a connection part that connects together the base part and the bearing accommodating part;

the bearing accommodating part includes a large inner diameter portion that supports the bearing, and a small inner diameter portion that is located between the large inner diameter portion and the connection part, that has a thickness greater than a thickness of the large inner diameter portion, and that has an inner diameter smaller than a diameter of the shaft;

a length of the connection part in a direction of the rotation axis of the shaft is shorter than a length of the base part in the direction of the rotation axis of the shaft, and is shorter than a length of the bearing accommodating part in the direction of the rotation axis of the shaft; and a first distance between an upper end of the shaft and a lower end of the small inner diameter portion in the direction of the rotation axis of the shaft is shorter than a second distance between an upper end of the rotor and a lower end of the large inner diameter portion in the direction of the rotation axis of the shaft.

6. A fuel pump comprising:

a cylindrical housing;

a pump cover that is provided at one end portion of the housing and includes an inlet port through which fuel is drawn into the housing;

a cover end that is provided at the other end portion of the housing and includes a discharge port through which fuel is discharged to outside of the housing;

a cylindrical stator on which a plurality of winding wires are wound and which is accommodated inside the housing;

a rotor that is rotatably provided radially inward of the stator;

a shaft that is provided coaxially with the rotor and rotates integrally with the rotor;

a bearing that is supported by the cover end and rotatably supports an end portion of the shaft on the cover end-side; and an impeller that is provided at an end portion of the shaft on the pump cover-side and rotates together with the shaft to pressurize fuel flowing in through the inlet port and to discharge the pressurized fuel through the discharge port, wherein:

the cover end includes:

a base part that covers the other end portion of the housing, a discharge part that is connected to the base part and includes the discharge port, a bearing accommodating part which includes an accommodating space that accommodates the bearing and which is formed such that a cross-section of the bearing accommodating part perpendicular to a rotation axis of the shaft has an annular shape point-symmetric with respect to a central axis of the accommodating space, a connection part that connects together the base part and the bearing accommodating part, an annular groove between a radially inward facing inner wall of the base part and an outer wall of the bearing accommodating part, and a bottom wall that defines the accommodating space is located further axially downward than a wall defining the annular groove;

the bearing accommodating part includes a large inner diameter portion that supports the bearing, and a small inner diameter portion that is located between the large inner diameter portion and the connection part, that has a thickness greater than a thickness of the large inner diameter portion, and that has an inner diameter smaller than a diameter of the shaft;

a length of the connection part in a direction of the rotation axis of the shaft is shorter than a length of the base part in the direction of the rotation axis of the shaft, and is shorter than a length of the bearing accommodating part in the direction of the rotation axis of the shaft; and a first distance between an upper end of the shaft and a lower end of the small inner diameter portion in the direction of the rotation axis of the shaft is shorter than a second distance between an upper end of the rotor and a lower end of the large inner diameter portion in the direction of the rotation axis of the shaft.

* * * * *